US009470498B1

(12) United States Patent
Cahayla et al.

(10) Patent No.: US 9,470,498 B1
(45) Date of Patent: Oct. 18, 2016

(54) HIGH PRESSURE ISOLATED LATCHING SAFETY SWITCH DEVICE

(71) Applicants: Jason Cahayla, West Milford, NJ (US); Jesse Sunderland, Franklin, NJ (US)

(72) Inventors: Jason Cahayla, West Milford, NJ (US); Jesse Sunderland, Franklin, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/625,674

(22) Filed: Feb. 19, 2015

Related U.S. Application Data

(60) Provisional application No. 62/046,429, filed on Sep. 5, 2014.

(51) Int. Cl.

| | |
|---|---|
| ***F42B 3/18*** | (2006.01) |
| ***F42C 15/32*** | (2006.01) |
| ***H01H 35/26*** | (2006.01) |
| ***F42C 5/00*** | (2006.01) |

(52) U.S. Cl.
CPC ..... *F42C 15/32* (2013.01); *F42C 5/00* (2013.01); *H01H 35/26* (2013.01)

(58) Field of Classification Search
CPC ..... F42C 15/32; F42C 5/00; H01H 35/26; H01H 35/24
USPC ..... 102/202.1
See application file for complete search history.

(56) References Cited

U.S. PATENT DOCUMENTS

| | | | | | |
|---|---|---|---|---|---|
| 3,585,933 | A * | 6/1971 | Kos | F42B 3/18 | 102/202.1 |
| 3,601,057 | A * | 8/1971 | Kline | F42C 19/06 | 102/263 |
| 3,630,150 | A * | 12/1971 | Rakowsky | F02K 9/95 | 102/205 |
| 3,672,300 | A * | 6/1972 | Axelson | F42C 5/00 | 102/205 |
| 3,894,490 | A * | 7/1975 | Zacharin | F42C 15/40 | 102/216 |
| 4,188,886 | A * | 2/1980 | Brauer | F42C 15/31 | 102/223 |
| 4,339,638 | A * | 7/1982 | Lascelles | H01H 39/00 | 102/216 |
| 4,592,281 | A * | 6/1986 | Nagennast | F42C 15/18 | 102/200 |
| 4,614,156 | A * | 9/1986 | Colle, Jr. | E21B 43/116 | 102/275.11 |
| 4,643,096 | A * | 2/1987 | Durrell | F42C 15/285 | 102/228 |
| 4,653,402 | A * | 3/1987 | Halssig | F42C 15/285 | 102/245 |

(Continued)

*Primary Examiner* — Michelle R Clement
(74) *Attorney, Agent, or Firm* — Michael C. Sachs

(57) ABSTRACT

A pressure switch is provided to arm a munition's fuze mechanism upon launch. The switch operation is based upon extreme gas pressures experienced during launch of the munition. The switch includes a piston contained in a housing. The piston translates due to launch pressures. The piston translation then causes a copper puck component to contact nearby electrical stab pins, to close a circuit. The closed circuit is then used to electrically arm the fuze mechanism.

3 Claims, 2 Drawing Sheets

(56) References Cited

U.S. PATENT DOCUMENTS 4,660,473 A * 4/1987 Bender ..... F15B 15/19 102/205
4,675,480 A * 6/1987 Jones ..... H01H 35/145 102/262
4,716,808 A * 1/1988 Hoch ..... F42C 15/28 89/1.807
4,899,659 A * 2/1990 Hardt ..... F42C 15/188 102/229
4,953,475 A * 9/1990 Munach ..... F42C 15/30 102/228
5,040,463 A * 8/1991 Beaverson ..... F42C 15/31 102/210
5,243,917 A * 9/1993 Komstadius ..... F42B 5/02 102/259
5,262,753 A * 11/1993 Duplaix ..... H01H 39/004 200/52 R
5,341,343 A * 8/1994 Aske ..... F41H 11/02 102/393
5,524,333 A * 6/1996 Hogue ..... H01H 35/34 29/593
5,693,906 A * 12/1997 Van Sloun ..... F42C 15/31 102/228
7,150,228 B2 * 12/2006 Scherge ..... F42B 3/006 102/223
7,258,068 B2 * 8/2007 Worthington ..... F42C 15/24 102/226
8,333,151 B2 * 12/2012 Krisher ..... F42B 10/46 102/378
8,635,872 B2 * 1/2014 Mayer ..... F42B 3/006 60/632
9,291,040 B1 * 3/2016 Hardesty ..... F42D 1/04
2005/0081732 A1 * 4/2005 Worthington ..... F42C 15/24 102/229
2005/0188877 A1 * 9/2005 Scherge ..... F42B 3/006 102/263

* cited by examiner

HIGH PRESSURE ISOLATED LATCHING SAFETY SWITCH DEVICE

CROSS REFERENCE TO RELATED APPLICATIONS

This application claims benefit under 35 USC§119 (e) from provisional application Ser. No. 62/046,429 filed Sep. 5, 2014, having same title and same inventor names, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

This invention solves the problem of a current lack of products available through the commercial market to provide a reliable, ultra high pressure, latching pressure switch to act as a second environment safety for ammunition fuzing systems. This problem has existed since the added military requirement that fuzes must also have a second environmental safety that is unrelated to the primary safety.

Old ways to provide a second safety include techniques such as a commit to launch function. In such technique, the munition is given an irreversible command, such as primer ignition, to act as a second input to the fuze, for safety. In the past, other techniques proposed devices that used temperature, heat, or spin, etc, to add an additional safety environment to the fuze. Many of these devices are not easily implementable to a 120 mm, un-spun, tank munition, e.g. These ways of solving the problem are unsatisfactory because in terms of fuze safety, it has been decided that there needs to be a more robust second environment than commit to launch, e.g., whereas temperature, heat and spin, as mentioned are not easily implementable. Clearly, an improved second safety device is needed for such high caliber munitions. For a 120 mm munition, it is proposed here to make the second safety depend on acceleration. This may be accomplished with a mechanism activated by the mounting gas pressure during a launch which causes such actual physical acceleration. The proposed mechanism would be physically placed in series with the round, preferably behind it, or at least behind the fuze mechanism, but other locations for this mechanism are theoretically possible.

BRIEF SUMMARY OF INVENTION

In the case of a 120 mm artillery projectile, e.g., by adding an environmental pressure switch, the fuze inherently becomes more safe. The pressure switch of this invention has a series piston actuator in series with the fuze and the propulsion means. This means that if the munition never sees a pressure environment (propulsion), the pressure switch is never closed to complete the electrical circuit. This would completely prevent the piston actuator from initiating the fuze, unintentionally.

The product proposed in this application provides a pressure switch design that is simple in nature, provides a reliable pressure threshold before actuation (5,000 psi), provides redundant multiple pressure sealing features, and is very reliable for the proposed uses. The device is easy to manufacture, and is relatively very inexpensive as compared to related products. Current static and ballistic pressure testing has shown that this device is capable of functioning up to a 100,000 psi range. The pressure switch of this invention is a simple design that allows ease of manufacture yet provides a robust electrical switch that is able to withstand these ultra high gun gas pressures to provide a solid electrical contact that additionally, remains closed for the entire duration of the ballistic event.

Objects of the Invention

Accordingly, it is an object of the present invention to provide a mechanical-electrical pressure switch for arming the fuze mechanism of a munition only upon launch thereof.

Another object of the present invention is to provide a switch to arm a munition upon launch which switch requires a reliable pressure threshold before actuation.

It is a further object of the present invention to provide a switch to arm a munition upon launch, whereby such switch employs multiple sealing methods to protect the switch against leaking gas pressure into the munition, after the switch has first been actuated.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
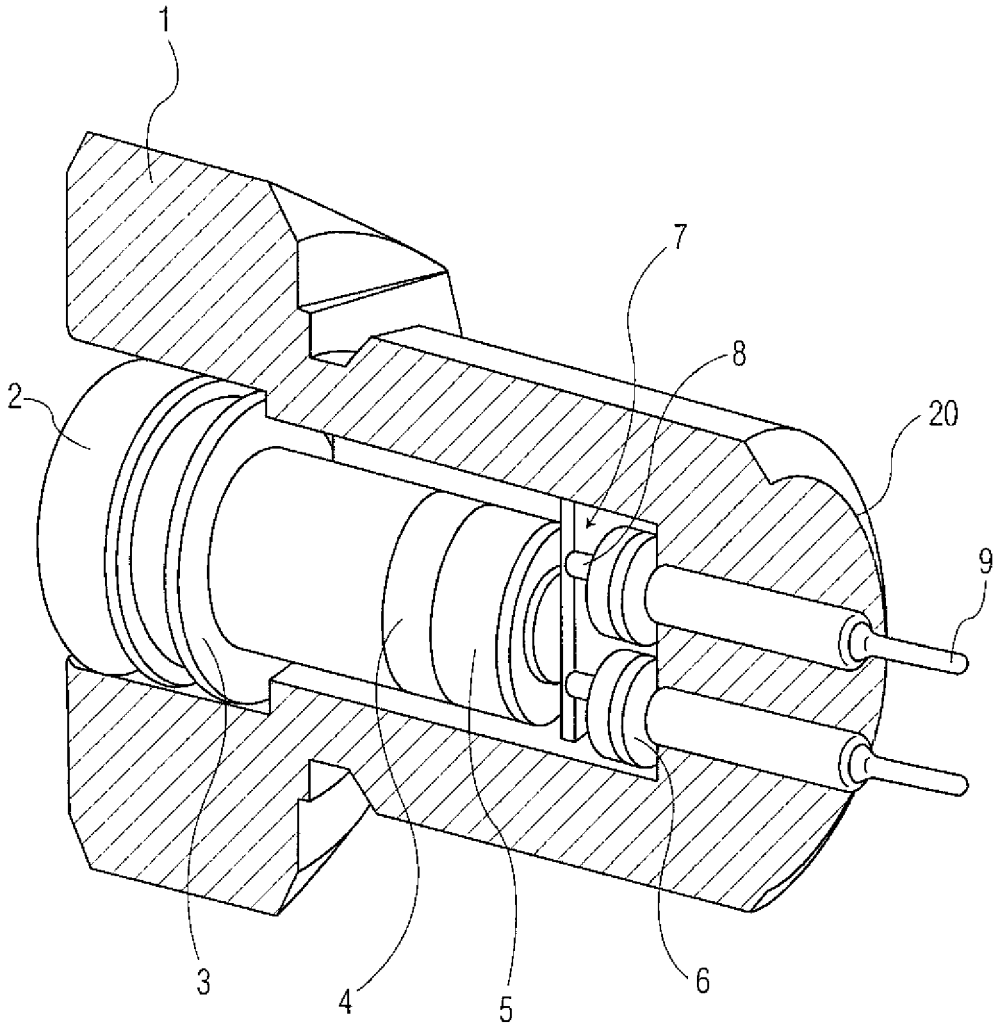
FIG. 1 shows a cutaway view of the pressure switch assembly according to this invention.

The design of the pressure switch is shown in FIG. 1. The components are designed such that there are no special machining operations, welding, or complicated assembly operations to manufacture this device. All of the internal components of the pressure switch lend themselves to be manufactured in a high production environment with the use of Swiss-type screw machines and plastic injection molding processes to keep production costs extremely low.

Figure 2:
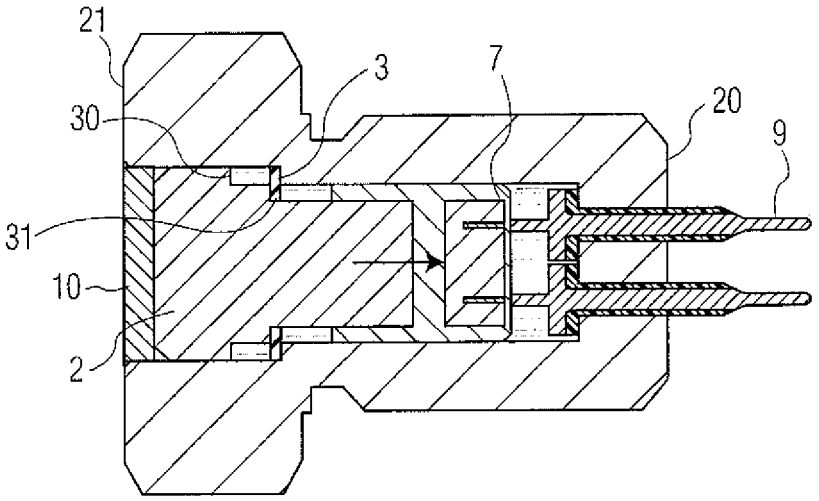
FIG. 2 shows a cross sectional view of the pressure switch assembly, with only open contacts, prior to application of pressure, according to this invention.
Figure 3:
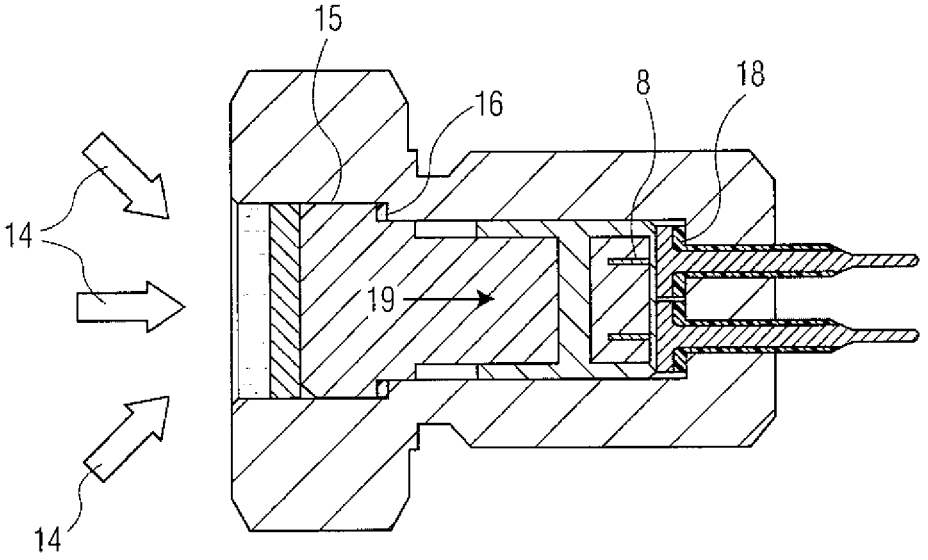
FIG. 3 shows a cross sectional view of the pressure switch assembly, with closed contacts due to application of launch pressures, according to this invention.

A hollow 17-4 stainless steel housing 1 contains all of the components of the proposed pressure switch, and provides a M12×1 internal thread means (not completely shown) of fastening this switch to a munition. The housing has a defined forward end 20, as well as a rear end 21 shown in FIG. 2. The piston 2 is made of 17-4 stainless steel and provides for conversion of gas pressure into linear motion for the switch to function. The piston has two forward shoulders (30, 31, shown in FIG. 2). An aluminum shear disc 3 at the forward most shoulder 31 provides a specific pressure threshold which in this case is approximately 5,000 psi before the switch device can activate. A copper stab puck 5 forms the conductive bridge element that will provide electrical conductivity between both stab pins 8 once the switch has been functioned. The copper stab puck 5 has a circumferential groove on the front face that can accept the stab pins 8 in an interference fit because the pin diameter is larger than the groove width. This interference fit between the stab pins 8 and copper stab puck 5 adds robustness for electrical continuity because the two elements resist separation after mating. The design of the annular groove also provides easy insertion of the pin into groove because the insertion does not depend on angular orientation of the conductive puck. Two insulating elements, an Ultem® polyetherimide outer insulator 7 and an Ultem® insulating puck 4, provide electrical insulation to the copper stab puck 5 in the assembly to prevent unintentional grounding of the housing 1, and also to provide a standoff from the stab pins 8. A very thin web of insulating material not completely shown on Ultem® outer insulator 7 provides an insulating boundary for the stab pins 8 to pierce through once the switch is functioned. The two stab pins 8 are electrically insulated with Ultem pin insulators 6 to prevent continuity with housing 1. These stab pins 8 will pierce through the Ultem® outer insulator 7 and be accepted into the copper stab puck 5 to form a conductive bridge between the two stab pins 8. Connection terminals 9 are provided on the distal ends of both stab pins 8 to provide a mechanical connection to the fuze mechanism (not shown here) and/or for fuze second safety environment connection wires to be attached, e.g. The switch of this invention presents a robust design for sealing out gun gases. It has multiple sealing methods for keeping gun gas from entering into the munition as seen in FIGS. 2 and 3. One such seal is a room temperature vulcanizing RTV seal 10 on the front face of the piston that provides a flexible, heat resistant barrier which protects the pressure switch to the outside environment. The RTV also provides a seal to keep humidity outside of the switch. When applied to the front face of the piston, it will provide a conforming, heat resistant, flexible seal that will keep propellant gases from getting into the sides of the piston. When pressure 14 is applied to the outside of the switch, the RTV will conform to the front face and perimeter edges of the piston, and will translate accordingly with the piston once movement commences towards a closed switch position. Another seal occurs when the piston starts to translate after the shear disc has sheared. This interference fit between the piston and the housing further provides the effect of an extra sealing source on the piston perimeter wall, to further insure gun gas does not leak by the wall of the piston. The interference fit also provides a means to lock the piston in a closed position, as was mentioned previously, once a high enough gun pressure has been experienced to fully seat the piston to the internal shoulder of the housing. The bore that the piston translates into becomes increasingly more narrow, and eventually prevents much further translation. In this narrowed region, an aggressive press fit arrangement between the piston head and body (at 15 shown in FIG. 3) simultaneously provides a means of locking the piston in the closed position once a significant pressure field has been applied to the face of the piston in the range of approximately 10,000 psi. Another seal, 16, results from the shear disc material left over from the aluminum shear disc 3 shearing. Basically, the outer ring portion of the shear disc left from shearing forms a captured crush washer held between the piston and housing. As pressure continues to build during the ballistic event, the piston is driven into this crush washer material with increasing force such that the aluminum washer forms a metallic seal that conforms under great pressure to further seal and keep gun gases out. Another seal, 18, is the stab pin mated with the Ultem® insulators. These items act as a piston seal by design in the case that pressure is seen inside of the housing. Basically, the more pressure that is applied to the front face of the stab pins 8, the more sealing force is applied between a stab pin and the housing. The Ultem® insulator serves two functions in this application which are to isolate the stab pin electrically from the housing and to also provide a gasket sealing surface that will conform to the stab pin and housing, to prevent gas from getting into the munition fuze cavity.

A pre and post function cross section view are shown in FIGS. 2 & 3 with numbering to illustrate the basic function of the mechanical switch mechanism. Basically, once a pressure field 14 is applied to the outside of the pressure switch as in the case of propellant burning during gun firing, the pressure acts on the outer face of the piston 2 and therefore starts the axial translation19 of the piston. The internal aluminum shear disc 3 provides a means of preventing the switch from translating and closing the switch contacts until an upper limit of pressure for shearing has been exceeded. In the case of this design, a pressure threshold of approximately 5,000 psi is required to rupture the shear disc. After shearing and as pressure continues to build, the piston continues to travel forward and the two stab pins pierce through the thin web of Ultem® insulating material 7 that insulates the copper stab puck from the stab pins. Further translation and pressure continue piston translation and force the stab pins into the stab puck circumferential groove, thereby bridging electrical continuity between both stab pins 8. It is also possible to arrange this pressure switch to function so that the applied pressure will break an existing current connection, to stop an established flow of current to the fuze, e.g., as opposed to closing a circuit to first establish a flow of current as is shown here.

While the invention may have been described with reference to certain embodiments, numerous changes, alterations and modifications to the described embodiments are possible without departing from the spirit and scope of the invention as defined in the appended claims, and equivalents thereof.

What is claimed is:

1. In a munition including a fuze mechanism, and which munition experiences high gas pressures during the launching of such munition, a high pressure switch to provide a second safety against arming of the fuze mechanism in the absence of said high gas pressures, said switch comprising:

a steel housing (1) having a central area of circular cross section, said steel housing having a defined rearward looking end (21) and a defined forward looking end (20);

said steel housing comprising:

a pressure translatable piston (2) in said central area, said piston having a rearward looking face, and said piston also having a first forward looking shoulder (30), and a second forward looking shoulder (31); and an aluminum shear disc (3) positioned annularly on second forward looking shoulder (31) of said piston; and an polyetherimide insulating puck (4), and a copper stab puck (5), and electrical stab pins (8), and an polyetherimide outer insulator (7) to insulate said electrical stab pins from said copper puck, and polyetherimide pin insulators (6) to insulate said electrical stab pins from electrically contacting said steel housing, and external connection terminals (9) on said steel housing, and a vulcanizing seal (10) covering the rear face of said piston; and wherein, pressures experienced during the launching greater than 5,000 psi are transmitted to rupture the vulcanizing seal and thence such pressures are applied to the rear face of said piston, and whereupon said piston thereby translates in the forward looking direction, and wherein said piston therefore applies pressure upon said copper stab puck through said polyetherimide insulating puck, and wherein the pressure on said copper stab puck causes the electrical stab pins to physically contact the copper stab puck and thus to establish an electrical circuit between said electrical stab pins, and wherein said electrical stab pins may also communicate electrically through said external connection terminals for second safety arming the fuze mechanism, and whereby said electrical stab pins also pierce through said polyetherimide outer insulator in the process of contacting said copper stab puck, and wherein translation of said piston also causes a crushing of said aluminum shear disc to eventually cause cessation of piston translation, and whereby an interference fit (15) occurs at 10,000 psi between the wails of said piston and the steel housing, to further seal the high pressure switch against further pressure.

2. The switch of claim 1 wherein the copper stab puck (5) has a circumferential groove on its forward looking face, said groove sized to accept stab pins (8), regardless of angular orientation of the puck in an interference fit wherein the pin diameter is larger than the groove width such providing that the two elements resist separation after mating.

3. The switch of claim 2 wherein the copper stab puck (5) forms a conductive bridge element to provide electrical conductivity between the stab pins (8) once the switch has been functioned.

* * * * *